United States Patent [19]

Holtzman

[11] Patent Number: 4,650,265

[45] Date of Patent: Mar. 17, 1987

[54] ILLUMINATING LAMP ASSEMBLY FOR RETROFITTING AN EXIT SIGN

[76] Inventor: Jonathan Holtzman, 6118 Palomino Ct., W. Bloomfield, Mich. 48033

[21] Appl. No.: 597,819

[22] Filed: Apr. 9, 1984

Related U.S. Application Data

[63] Continuation-in-part of Ser. No. 335,252, Dec. 28, 1981, abandoned.

[51] Int. Cl.[4] ..... H01R 39/00

[52] U.S. Cl. ..... 339/1 L; 339/2 L; 339/6 R; 339/8 PS; 339/119 L

[58] Field of Search ..... 339/50–57, 339/1, 2, 7, 245; 40/545

[56] References Cited

U.S. PATENT DOCUMENTS

| | | | |
|---|---|---|---|
| 1,793,911 | 2/1931 | Dann | 339/245 |
| 1,938,962 | 12/1933 | Harris et al. | 339/57 |
| 2,451,539 | 10/1948 | Denning | 339/57 |
| 2,871,455 | 1/1959 | Richardson | 339/8 |
| 2,990,204 | 6/1961 | Golden | 339/7 |
| 3,909,100 | 9/1975 | Hodge, Jr. | 339/57 |
| 4,035,632 | 7/1977 | Rayman | 40/545 |
| 4,201,004 | 5/1980 | Witt | 40/545 |
| 4,382,647 | 5/1983 | Paley | 339/7 |

*Primary Examiner*—Gil Weidenfeld
*Assistant Examiner*—David L. Pirlot
*Attorney, Agent, or Firm*—Reising, Ethington, Barnard, Perry & Milton

[57] ABSTRACT

An illuminating lamp assembly (20,20') for supporting fluorescent tubes in an exit sign (10) including a body (22) for supporting a pair fluorescent tubes (24) and an electrical connector (26) rotatable about a first axis for threadedly engaging an electrical socket (18). A support member (28,60) interconnects the body (22) and the electrical connector (26) for allowing the electrical connector (26) to rotate about the first axis independently of the body (22). The assembly (20,20') is characterized by the body (22) including an elongated central portion (52) and positioning flanges (54) extending in opposite directions from each end thereof defining an H-shaped structure for supporting the fluorescent tubes (24) in positions visible from both sides of the body (22). Accordingly, the assembly (20,20') can be used to illuminate two opposite faces of an exit sign (10).

27 Claims, 7 Drawing Figures

ILLUMINATING LAMP ASSEMBLY FOR RETROFITTING AN EXIT SIGN

This is a continuation-in-part of application Ser. No. 335,252 filed Dec. 28, 1981 now abandoned.

TECHNICAL FIELD

The subject invention relates to an illuminating lamp assembly of the type having an electrical connector for engaging a socket of the type which normally receives the well known incondescent bulb but with the assembly supporting at least one fluorescent tube.

BACKGROUND ART

Public buildings utilize numerous exit signs indicating exit routes to the exterior of the building. The exit signs normally have at least one face with the word EXIT disposed thereon and bulbs behind the face for illuminating a normally red translucent covering over the word EXIT. The exit signs remain on twenty-four (24) hours a day and frequently utilize special bulbs which have a short life and are expensive. Further, most exit signs have two electrical sockets for receiving two bulbs within the sign. These sockets are variably positioned within the exit sign box in that they may extend from the sides or from the ends.

Fluorescent tubes could more efficiently be utilized in the exit signs, as they would experience longer life and use significantly less energy. There is not now, however, available any fluorescent tube assembly which may be utilized in an exit sign, particularly to retrofit an existing sign having bulb sockets. Retrofitting requires flexibility in the assembly to allow access to the bulb while making the assembly adaptable to various shaped and wire exit sign housings.

Many existing exit signs have opposite faces which must be illuminated. In retrofitting a fluorescent tube assembly for an exit sign fixture, the assembly must be adapted to illuminate both faces of the exit sign while providing an efficient use of energy. Further, the assembly must illuminate the entire face of the exit sign fixture box, not leaving darkened areas.

In assemblies adapted to mount a fluorescent tube within an exit sign, the fixture supporting the tube is generally connected directly to the exit sign box and wires lead from the box to a connector which is threadedly inserted into a socket in the exit sign. Since the connector must be threadably engaged within the socket, mounting of the connector within the socket tends to twist the interconnecting wires to the body of fixture. Stresses on the wires can break the connections and create a dangerous situation. These prior art structures require the light fixture to be mounted within the exit sign box thereby requiring extensive alterations of the box to adapt the box to the fixture.

Electrical fixtures are known in the art which support fluorescent tubes for illumination and include a connector for engaging the conventional threaded bulb socket. An example of one such fixture is shown in U.S. Pat. No. 2,871,455 granted Jan. 27, 1959 to N. H. Richardson. That assembly includes an elongated body for supporting two fluorescent tubes with an electrical connector extending from one side of the body midway of the length thereof. Thus, that assembly is positioned in the open space in front of a socket and because of its configuration would not be satisfactory for disposition within an exit sign.

STATEMENT OF INVENTION AND ADVANTAGES

An illuminating lamp assembly for supporting fluorescent tubes in an exit sign including a body for supporting a pair of fluorescent tubes and electrical connector means rotatable about a first axis for threadedly engaging an electrical socket. Support means interconnects the body and the electrical means for allowing the electrical connector means to rotate about the first axis independently of the body. The assembly is characterized by the body including an elongated central portion and positioning means at each end thereof for supporting the fluorescent tubes in positions visable from both sides of the body.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
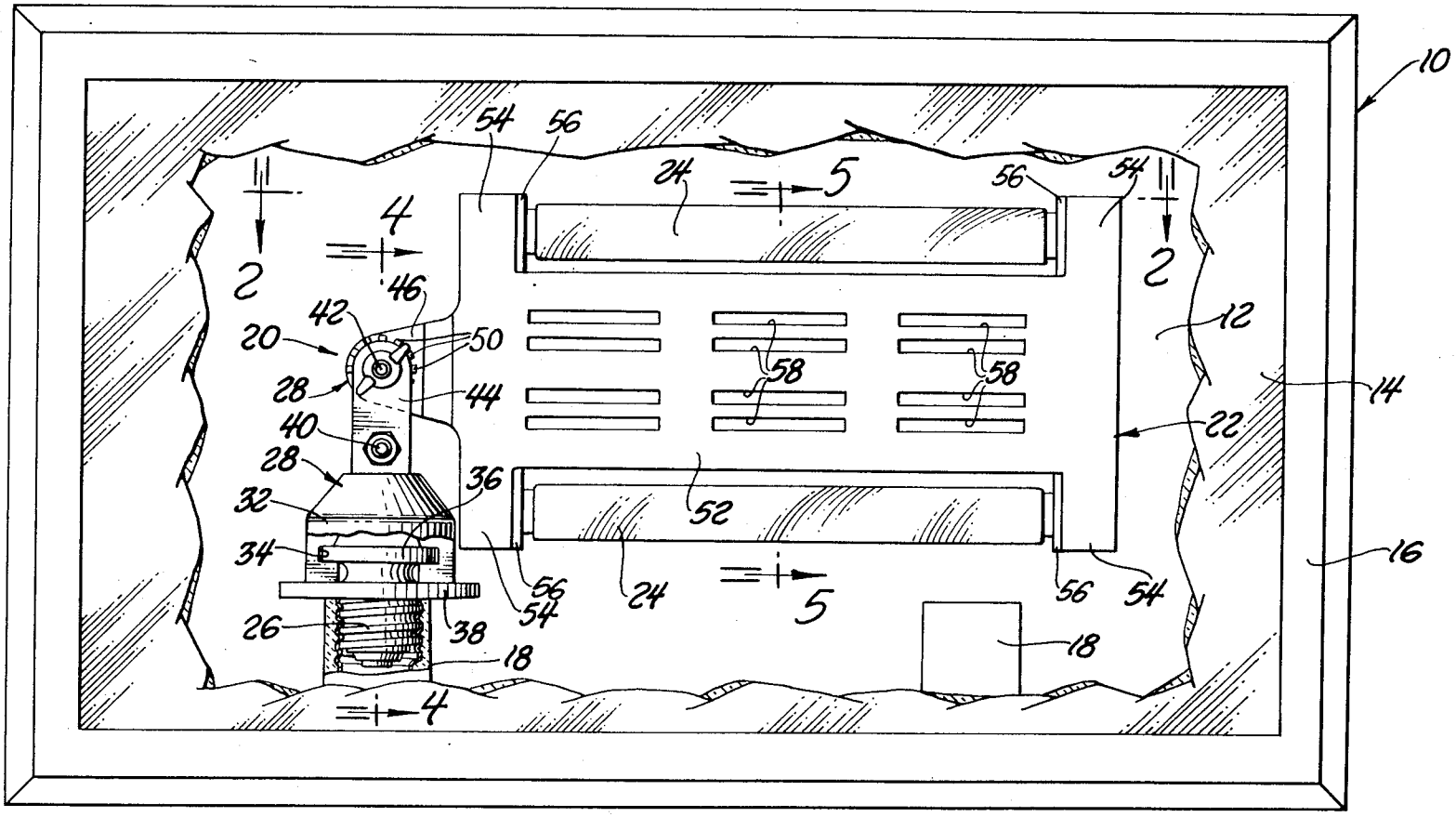
FIG. 1 is an elevational view partially broken away and in cross section of the illuminating lamp assembly of the subject invention disposed within an exit sign box.

A sign utilizing the subject invention is shown in FIG. 1. The sign includes a rectangular box generally indicated at 10. The box 10 has spaced rectangular faces 12 and 14. The faces 12 and 14 are supported within a frame 16. The sign 10 is typical of an exit sign wherein one or both of the faces 14 have light passing openings therein spelling out EXIT. Typically, within the faces 12 and 14 will be a red translucent material so that the word EXIT appears in red when the sign is illuminated. The sign box 10 would have appropriate brackets or holes about the periphery for attachment to a support structure. A pair of sockets 18 are disposed in the box between the faces 12 and 14. The sockets 18 are of the conventional type for threadedly receiving an electrical device, typically a light bulb. The sockets 18 are attached to an electrical source of power in a conventional manner.

An illuminating lamp assembly constructed in accordance with the subject invention is gewnerally shown at 20. The assembly 20 includes a body generally indicated at 22 for supporting a pair of fluorescent tubes 24.

The assembly 20 includes electrical connector means defined by the threaded male connector 26 which is rotatable about a first axis for threadedly engaging and disengaging the electrical socket 18.

The assembly further includes support means, generally indicated at 28, interconnecting the body 22 and the electrical connector 26 for allowing the connector 26 to rotate about the first axis independently of the body 22 to threadedly engage the socket 18 and for allowing the body 22 to be adjusted relative to the connector 26 about a second axis which is perpendicular to the faces 12 and 14 and to the first axis about which the connector 26 rotates. The support means 28 includes a stem member 30,32 rotatably connected to the connector member 26. The stem is defined by two identical parts or halves 30 and 32 which define an annular groove 34. The connector member 26 includes a radially extending flange or wheel portion 36 rotatably retained in the annular groove 34. The connector member 26 also includes an annular flange or wheel 38 for manually rotating the connector member 26. A fastener bolt 40 extends through and holds together the parts 30 and 32 of the stem.

The support means 28 further includes an adjustment means interconnecting the stem 30,32 and the body 22 for adjusting the relative position between the stem 30,32 and the body 22 about the second axis whereby the body 22 is supported by the stem 30,32 and the stem 30,32 is supported by the connector member 26 when the connector member 26 is threadedly engaging the socket 18. More specifically, the adjustment means includes a fastener bolt 42 and wing nut assembly extending through a pair of spaced ears 44 defined by the upper ends of the stem members 30 and 32. In addition, a mounting flange 46 extends from one end of the body 22 and is disposed between the ears 44. The fastener bolt 42 extends through the ears 44 and the mounting flange 46 and may be loosened to allow relative rotation about the second axis (which is the axis of the bolt 42) between the body 22 and the stem 30,32. The bolt 42 may be tightened to prevent the relative rotation about the axis of the bolt 42. Coacting teeth or ridges or ribs 48 and 50 are disposed upon the ears 44 and the mounting flange 46, respectively, for coacting engagement when the bolt 42 clamps the ears 44 against the mounting flange 46 to prevent relative rotation about the second axis (or axis of the bolt 42) between the body 22 and stem 30,32.

Figure 2:
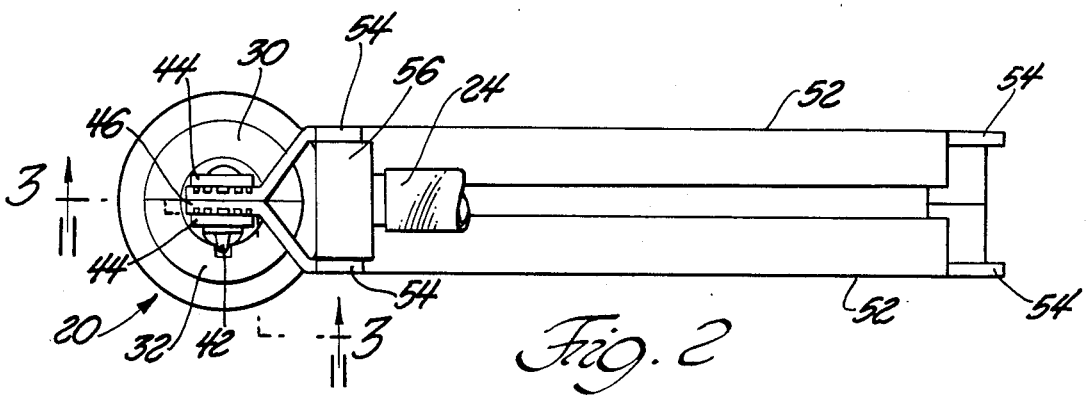
FIG. 2 is a plan view taken substantially along line 2—2 of FIG. 1.
Figure 3:
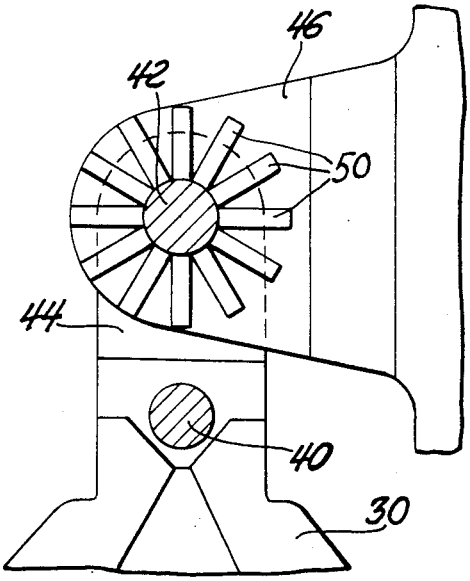
FIG. 3 is an enlarged fragmentary cross-sectional view taken substantially along line 3—3 of FIG. 2.
Figure 4:
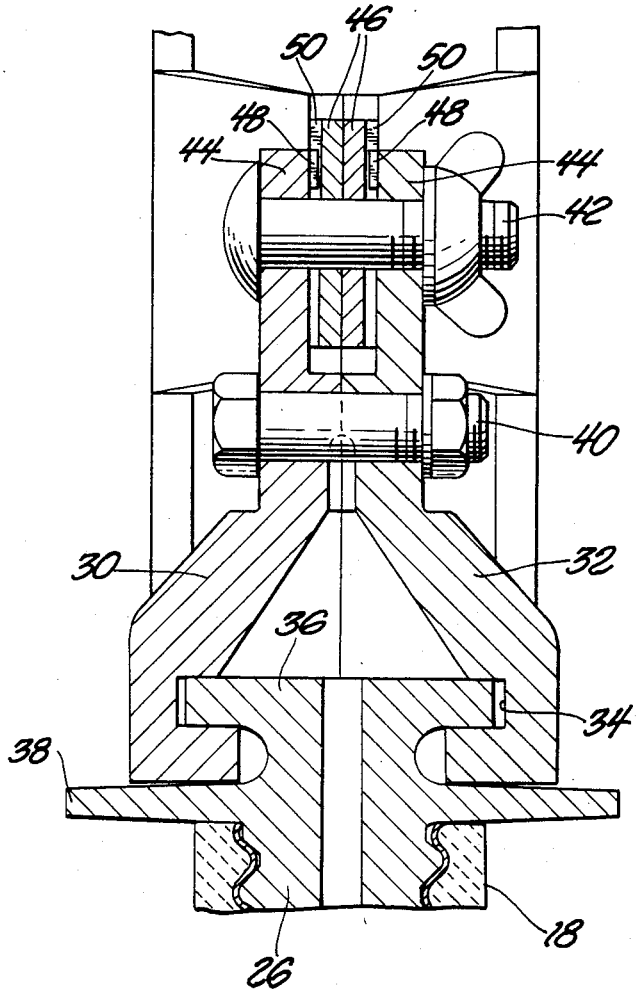
FIG. 4 is an enlarged fragmentary cross-sectional view taken substantially along line 4—4 of FIG. 1.
Figure 5:
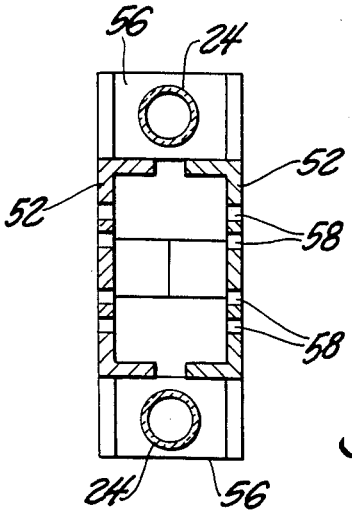
FIG. 5 is a cross-sectional view taken substantially along line 5—5 of FIG. 1.

The body 22 has oppositely facing sides with fluorescent tube positioning means included for supporting the fluorescent tubes 24 in positions which would be visible from both sides 52 and therefore provide illumination against both faces 12 and 14 of the sign 10. The body 22 includes an elongated central portion with positioning flanges 54 extending in opposite directions from each end of the central body portion to define the positioning means for supporting the fluorescent tubes 24 along the opposite extremities of the central portion of the body 22. As shown at the left end of FIG. 2, an electrical connector or receiving device 56 is supported between the two spaced flanges 54; it being understood that although not shown, such devices 56 are disposed at each end of the central portion, both top and bottom. The fluorescent tubes 24 extend between the electrical connectors 56 from which they receive their electrical power. The body 22 is defined by two identical parts secured together as by glue, welding, or the like, so that each part defines one of the sides 52 and one-half of the mounting flange 46. As best seen in FIG. 5, the two parts of the body form a generally rectangular housing along the central portion of the body 22 with the opposite faces thereof including the openings 58. Conventional electrical components may be disposed within the housing defined by the body 22, such as a conventional balest circuit utilized with fluorescent tubes.

Although the subject invention may have many uses, it is particularly well suited for retrofitting exit signs which now require special expensive bulbs utilizing the relatively high amount of electrical power. The electrical sockets 18 shown as extending in parallel relationship from one side of the sign box 10; however, as alluded to above, the electrical sockets 18 may be at the ends of the box 10. If a socket 18 were at the end of the box 10, then the fastening asembly 42 would be loosened and the stem 30,32 would be rotated clockwise, as viewed in FIG. 1, to position 90° from the shown the fastener 42 tightened again to prevent any further relative rotation between the body 22 and the stem 30,32. In fixed position the connector 26 could be threaded into a socket on the end of the sign box 10 to maintain the body 22 in the same horizontal position illustrated. Further, by utilizing the subject invention only one of the sockets 18 need be utilized because the assembly provides two fluorescent lamps.

Figure 6:
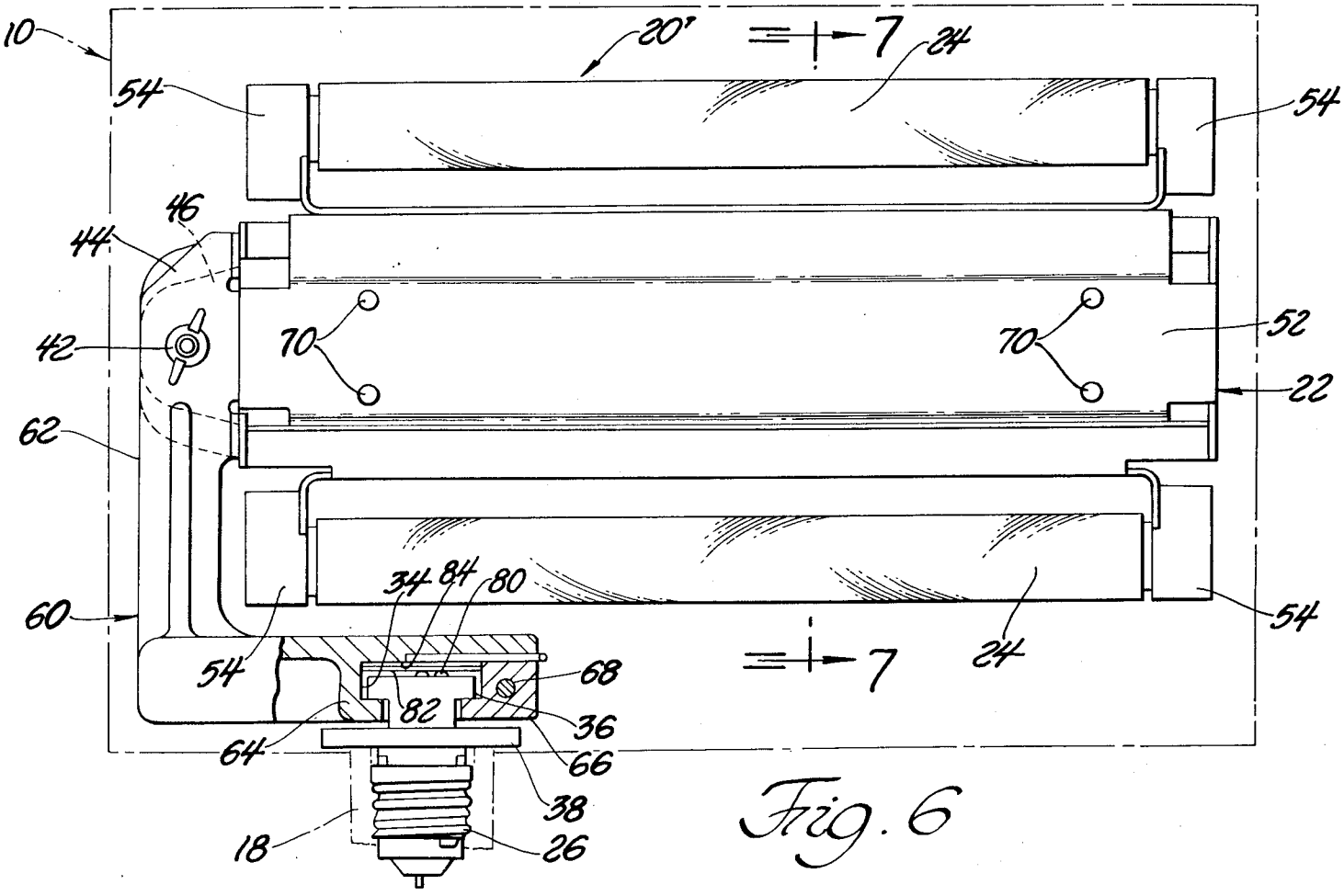
FIG. 6 is an elevational view of a second embodiment of the subject invention.

A second embodiment of the invention is shown in FIG. 6. Like numerals are used to indicate like structures of the two embodiments.

The second embodiment of the illuminating lamp assembly is generally shown at 20' in FIG. 6. The assembly 20' includes a body 22 for supporting the pair of fluorescent tubes 24. The electrical connector means 26 is rotatable about the first axis for threadedly engaging the electrical socket 18. Support means 60 interconnects the body 22 and the electrical connector means 26 for allowing the electrical connector means 26 to rotate about the first axis independently of the body 22. The assemblies 20, 20' are characterized by the body 22 including an elongated central portion 52 and positioning means 54 extending in opposite directions from each end thereof defining an H-shaped structure for supporting the fluorescent tubes 24 in positions visible from both sides of the body 22. In this manner, a retrofitted assembly may comprise only two fluorescent tubes 24 yet illuminate the opposite faces of a pre-existing exit sign without any further requirements for additional fluorescent tubes. The assemblies provide an efficient means for illuminating a two faces of the exit sign with a retrofitted assembly while further providing the advantages of fluorescent tubes as discussed above.

The assembly includes independent circuits housed within the body 22 for powering each of the fluorescent tubes 24 independently. The circuits are of the type disclosed in the copending pending U.S. patent to Holtzman and Tracey Ser. No. 592,853 filed 3-23-84. The independent circuits provide a means for insuring that if one of the fluorescent tubes 24 fails, then the other fluorescent tube will continue to illuminate the exit sign 10. This is an Underwriter Laboratories and general safety code requirement which is fulfilled by the instant invention. Moreover, due to the placement of the fluorescent tubes 24 by the positioning means 54, failure of one fluorescent tube 24 does not result in substantial darkening to a significant portion of either face of the exit sign. The single functioning fluorescent bulb 24 would substantially illuminate the entire length of the EXIT openings of the exit sign 10.

The combination of the H-shaped construction of the body 22 and the connector means 26 with the circuitry of the above mentioned copending application make the instant invention readily mountable within almost all existing exit signs presently using incandescent bulbs. Conventional wire wound ballast fixtures could not be filled in these assemblies and center the bulbs.

More particularly, the positioning means includes positioning flanges 54. As discussed above, an electrical connector or a receiving device would be supported between the two spaced flanges 54.

The assembly 20' is further adapted to center the body 22 and the supported tubes 24 within the exit sign fixture. The support means 60 is an L-shaped stem, a first leg 62 of the L-shaped stem 60 including the spaced ears 44 for supporting the body 22 therefrom. A second leg 64 of the L-shaped stem 60 is rotatably connected to the connector means 26. The body 22 includes the mounting flange 46 extending a predetermined distance away from the body 22 to dispose at least one positioning flange 54 within the L-shaped stem 60 for positioning at least portion of the fluorescent tubes 24 over the connector means 26 thereby centering the fluorescent tubes within an exit sign box assembly. There is no sacrifice of illuminating capability as the support means is specifically constructed to center the tubes 24. Although the assembly 20' is shown to include an adjustable wing nut 42, the mounting flange 46 may be fixedly connected to the spaced ears 44 by suitable fastening means.

The connector means 26 includes the radially extending annular flange 36, the second leg 64 of the L-shaped stem 60 including an annular groove 34 rotatably disposed over the flange 36. The L-shaped stem 60 includes an insert member 66 defining a portion of the annular groove 34. The insert member 66 is removably connected to the L-shaped stem 60 for allowing insertion of the flange 36 within the annular groove 34 when the insert member 66 is removed and for retaining the flange 36 within the annular groove 34 when the insert member 66 is connected to the L-shaped stem 60. In this manner, the stem 60 is constructed as a unitary structure rotatably connected on the flange portion 36 of the connector member 26 by the attachment of the insert member 66.

Figure 7:
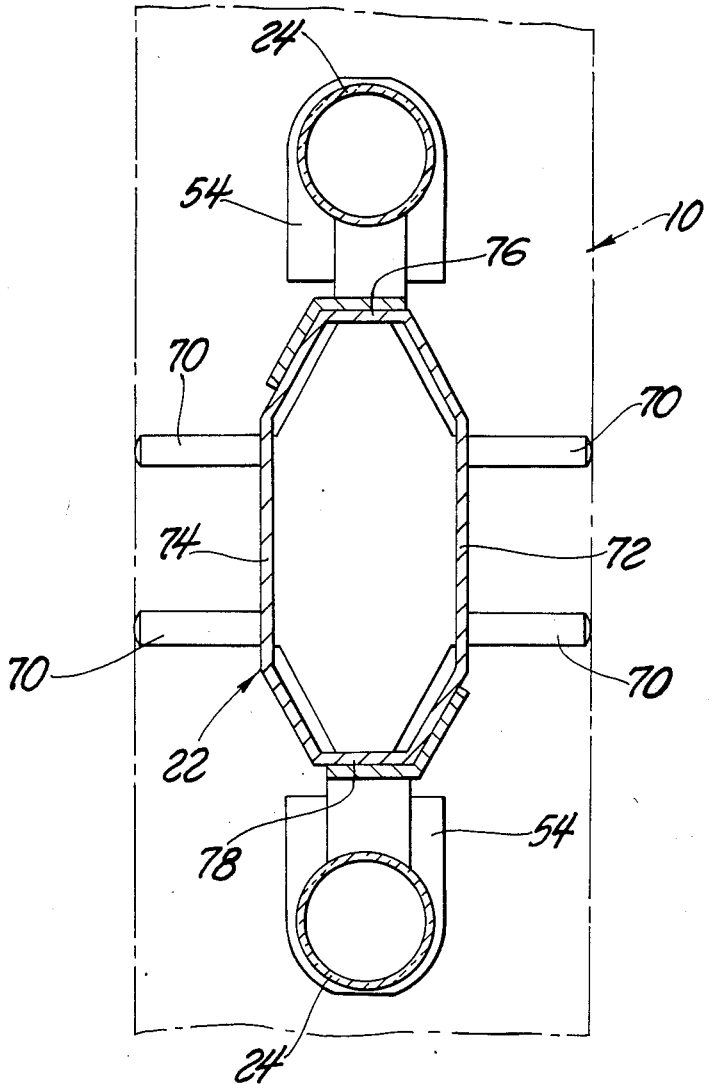
FIG. 7 is a cross sectional view taken substantially along lines 7—7 of FIG. 6.

The body 22 has opposite facing front and rear walls 72,74 and top and bottom walls 76,78. The front and rear walls 72,74 taper inwardly towards the top and bottom walls 76,78 as shown in FIG. 7. The tapered corners between the side walls 72,74 and the top and bottom walls 76,78 allow for maximum illumination by the fluorescent tubes of the faces of the exit sign 10. If the corners of the walls 72,74 and 76,78 were squared, then the top and bottom walls 76,78 would block a substantial amount of the illumination from the fluorescent tubes 24. The tapering of the walls 72,74 towards the top and bottom walls 76,78 allows for significantly increased efficiency by allowing a substantially increased amount of irradiation to pass from the fluorescent bulbs 24 to the faces of the sign 10.

The connector means 26 includes electrical contact means 80 extending upwardly therefrom. The support means 60 includes second electrical contact means 82 operatively connected to the first contact means 80 for conducting electricity therebetween while rotation therebetween. Specifically, the first mentioned electrical contact means 80 includes a first plate 80 and the second electrical contact means 82 includes a second plate 82 contacting the first plate 80 for conductance of electricity therebetween. The second plate 82 is supported from an inner surface 84 of the annular groove 34. The first plate 80 is supported above an upper surface of the radially extending flange 36 to establish the electrical connection through a full 360° rotation of the connector 26 relative to the support means 60. Thusly, wires running between the connector 26 and support means 60 are eliminated. Unlike prior art assemblies wherein a connector having wires extending therefrom would twist the wires making the wire connections stressed and potentially unsafe, the instant invention provides a safe connection not having any of the problems inherent in having a wire operatively connected between the connector 26 and the support means 60. In this manner, the support means 60 and body 22 are totally independent of the connector 26. Yet the connector 26 provides the sole means for supporting the support means 60 and body 22 within the exit sign 10. Unlike prior assemblies wherein the body supporting the lamps would need to be physically connected to the box of the exit sign 10, the instant invention provides means for supporting the lamps from the connector disposed within the electrical socket of the exit sign box.

The assembly may include body anti-rotation means 70 for preventing the body 22 from rotating with the support means 60 about the connector means 26 when retained within a box 10 to fixedly secure the body 22 within the box 10 and fixedly space the body 22 from the inner walls of the box 10. Since the body 22 and support means 60 are rotatable about the connector means, it is possible for the body to come in contact with the box fixture 10. The anti-rotation means 70 prevents rotation of the body 22 within the box 10 to fixedly position the body 22. Specifically, the body anti-rotation means includes at least one prong 70 or as shown in FIG. 6 four prongs 70 extending away from each side of the body 22 to engage the box 10 and space the body 22 from the box 10.

The instant invention provides an assembly, unlike the prior art, which is sized to be readily mounted in existing fixtures. The assembly centers the bulbs and provides a safe connection to the already existing socket and supports the entire fixture from the socket. These features provide effective lighting that is significantly safer and more efficient than prior art assemblies.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An illuminating lamp assembly (20) for supporting fluorescent tubes in an exit sign box (10) comprising; a body (22) for supporting at least one fluorescent tube (24), and electrical connector means (26) rotatable about a first axis for threadedly engaging an electrical socket (18) within the exit sign box characterized by support means (28) interconnecting said body (22) and said electrical connector means (26) for allowing said connector means (26) to rotate about said first axis independently of said body (22) to threadedly engage the socket (18) while said body is in proximity of the exit sign box and for allowing said body (22) to be adjusted relative to said connector means (26) about a second axis (42) which is perpendicular to said first axis.

2. An assembly as set forth in claim 1 further characterized by said support means (28) including a stem (30,32) rotatably connected to said connector means

(26) and adjustment means interconnecting said stem (30,32) and said body (22) for adjusting the relative position between said stem (30,32) and said body (22) about said second axis (42) whereby said body (22) is supported by said stem (30,32) and said stem (30,32) is supported by said connector means (26) when said connector means (26) is threadedly engaging the socket (18).

3. An assembly as set forth in claim 2 further characterized by said adjustment means including a fastener (42) for loosening to allow relative rotation about said second axis between said body (22) and said stem (30,32) and for tightening to prevent said relative rotation about said second axis (42).

4. An assembly as set forth in claim 3 further characterized by said body (22) having oppositely facing sides (52) and tube positioning means (54) for supporting a fluorescent tube (24) in a position visible from both sides (52) of said body.

5. An assembly as set forth in claim 4 further characterized by said body (22) including an elongated central portion and positioning flanges (54) extending in opposite directions from each end thereof to define said positioning means for supporting a fluorescent tube (24) along the opposite extremities of said central portion.

6. An assembly as set forth in claim 5 further characterized by said adjustment means including a pair of spaced ears (44) defined by said stem (30,32) and a mounting flange (46) extending from one end of said central portion (52) of said body (22) and disposed between said ears (44), said fastener (42) extending through said ears (44) and said mounting flange (46) to clamp said ears (44) against said mounting flange (46).

7. An assembly as set forth in claim 6 further characterized by including coacting teeth (48,50) on said ears (44) and said mounting flange (46) for coacting engagement in the clamped position to prevent said relative rotation.

8. An assembly as set forth in claim 7 further characterized by said body (22) being defined by two identical parts secured together so that each part defines one of said sides (52) and one-half of said mounting flange (46).

9. An assembly as set forth in claim 8 further characterized by said stem (30,32) being defined by two identical parts (30,32) defining an annular groove (34), said connector means (26) having a radial flange (36) rotatably retained in said annular groove (34).

10. An assembly as set forth in claim 9 further characterized by including a fastener (40) holding together said parts (30,32) of said stem.

11. A sign comprising; a rectangular box (10) having spaced rectangular faces (12,14) with at least one face having light passing openings therein, at least one socket (18) in said box (10) between said faces (12,14) for threadedly receiving an electrical device, electrical connector means (26) rotatable about a first axis and in threaded engagement with said socket (18), a body (22) supporting at least one fluorescent tube (24), support means (28) interconnecting said body (22) and said electrical connector means (26) for allowing said connector means (26) to rotate about said first axis independently of said body (22) to rotate in said socket (18) and for allowing said body (22) to be adjusted relative to said connector means (26) about a second axis (42) which is perpendicular to said faces (12,14) of said box (10) and to said first axis.

12. An illuminating lamp assembly (20,20') for supporting fluorescent tubes (24) in an exit sign (10), said assembly (20,20') comprising: a body (22) for supporting a pair of fluorescent tubes (24); electrical connector means (26) rotatable about a first axis for threadedly engaging an electrical socket (18); and support means (28,60) interconnecting said body (22) and said electrical connector means (26) for allowing said electrical connector means (26) to rotate about said first axis independently of said body (22), said assembly (20,20') characterized by said body (22) including an elongated central portion (52) and positioning means (54) at each end thereof for supporting the fluorescent tubes (24) in positions visible from both sides of said body (22), said positioning means (54) including positioning flanges (54) extending in opposite directions from each end of said body (22) to define an H-shaped structure, said support means (60) being an L-shaped stem, a first leg (62) of said L-shaped stem: (60) including spaced ears (44) for supporting said body (22) therefrom and a second leg (64) of said L-shaped stem (60) being rotatably connected to said connector means (26).

13. An assembly as set forth in claim 12 further characterized by said body (22) including a mounting flange (46) extending a predetermined distance away from said body (22) to dispose said positioning means (54) within said L-shaped stem (60) for positioning at least a portion of a fluorescent tube (24) over said connector means (26).

14. An assembly as set forth in claim 13 further characterized by said support means (26) including a radially extending flange (36), said second leg (64) of said L-shaped stem (60) including an annular groove (34) rotatably disposed over said flange (36).

15. An assembly as set forth in claim 14 further characterized by said L-shaped stem (60) including an insert member (66) defining a portion of said annular groove (34), said insert member (66) being removably connected to said L-shaped stem (60) for allowing insertion of said flange (36) within said annular groove (34) when said insert member (66) is removed and for retaining said flnages (36) within said annular groove (34) when said insert member (66) is connected to said L-shaped stem (60).

16. An illuminating lamp assembly (20,20') for supporting fluorescent tubes (24) in an exit sign (10), said assembly (20,20') comprising: a body (22) for supporting a pair of fluorescent tubes (24); electrical connector means (26) rotatable about a first axis for threadedly engaging an electrical socket (18); and support means (28,60) interconnecting said body (22) and said electrical connector means (26) for allowing said electrical connector means (26) to rotate about said first axis independently of said body (22), said assembly (20,20') characterized by said body (22) including an elongated central portion (52) and positioning means (54) at each end thereof for supporting the fluorescent tubes (24) in positions visible from both sides of said body (22), said positioning means (54) including positioning flanges (54) extending in opposite directions from each end of said body (22) to define an H-shaped structure, said support means (60) being an L-shaped stem, a first leg (62) of said L-shaped stem (60) including spaced ears (44) for supporting said body (22) therefrom and a second leg (64) of said L-shaped stem (60) being rotatably connected to said connector means (26), said connector means (26) including first electrical contact means (80) extending upwardly therefrom, said support means (60) including second electrical contact means (82) operatively connected to said first contact means (80) for conducting electricity therebetween while allowing for relative rotation therebetween.

17. An assembly as set forth in claim 16 further characterized by said connector means (26) including a radially extending flange (36), said second leg (64) of said L-shaped stem (60) including an annular groove (34) rotatably disposed over said flangew (36).

18. An assembly as set forth in claim 17 further characterized by said annular groove (34) including an inner surface (84), said second plate (82) being supported from said inner surface, said radially extending flange (36) having an upper surface supporting said first electrical contact means (80) against said second electrical contact means (82) to establish an electrical connection through a full 360° rotation of said connector means (26) relative to said support means (60).

19. A sign assembly comprising: a rectangular box (10) having spaced rectangular faces (12,14) with at least one of said faces having light passing openings therein; at least one socket (18) in said box between said faces (12,14) for threadedly receiving an electrical device; electrical connector means (26) rotatable about a first axis and in threaded engagement with said socket (18); a body (22) supporting a pair of fluorescent tubes (24); and characterized by support means (60) for interconnecting said body (22) and said connector means (26) to rotate about said first axis independently of said body (22) and to rotate in said socket (18) for positioning said body (22) centrally within said box (10) and for positioning the fluorescent tubes (24) to illuminate the length of said light passing openings, said support means (60) being an L-shaped stem, a first leg (62) of said L-shaped stem (60) including spaced ears (44) for supporting said body (22) therefrom and a second leg (64) of said L-shaped stem (60) being rotatably connected to said connector means (26).

20. An assembly as set forth in claim 19 further characterized by said body (22) including a mounting flange (46) extending a predetermined distance away from said body (22) to dispose tube positioning means (54) within said L-shaped stem (60) for positioning at least a portion of a fluorescent tubes (24) over said connector means (26).

21. An assembly as set forth in claim 20 further characterized by said connector means (26) including a radially extending flange (36), said second leg (64) of said L-shaped stem (60) including an annular groove (34) rotatably disposed over said flange (36).

22. An assembly as set forth in claim 21 further characterized by said L-shaped stem (60) including an insert member (66) defining a portion of said annular groove (34), said insert member (66) being removably connected to said L-shaped stem (60) for allowing insertion of said flange (36) within said annular groove (34) when said insert member (66) is removed and for retaining said flanges (36) within said annular groove (34) when said insert member (66) is connected to said L-shaped stem (60).

23. An assembly as set forth in claim 19 further characterized by including body anti-rotation means (70) for preventing said body (22) from rotating with said respect to said box (10) when retained within said body (10) to fixedly secure body (22) within said box (10) and fixedly space said body (22) from said box (10).

24. An assembly as set forth in claim 23 further characterized by said body anti-rotation means including at least one prong (70) extending away from each side of said body (22) to engage said box (10) and space said body (22) from said box (10).

25. An illuminating lamp assembly (20,20') for supporting fluorescent tubes (24) in an exit sign (10) including at least one electrical socket (18), said assembly (20,20') comprising: a body (22) for supporting a pair of fluorescent tubes (24); electrical connector means (26) rotatable about a first axis for threadedly engaging the electrical socket (18); support means (28,60) interconnecting said body (22) and said electrical connector means (26) and being rotatable for 360° relative to said connector means (26); and characterized by first and second electrical contact means (80,82) being supported between said support means (28,60) and said electrical connector means (26), respectively, for electrically connecting said electrical connector means (26) and said support means (28,60) while allowing for a full 360° rotation of said electrical connector means (26) relative to said support means (60), said first mentioned electrical contact means (80) including a first plate (80) and said second electrical contact means (82) including a second plate (82) contacting said first plate (80) for the conducting of electricity therebetween, said support means (60) being an L-shaped stem, a first leg (62) of said L-shaped stem (60) including spaced ears (44) for supporting said body (22) therefrom and a second leg (64) of said L-shaped stem (60) being rotatably connected to said connector means (26).

26. An assembly as set forth in claim 25 further characterized by said connector means (26) including a radially extending flange (36), said second leg (64) of said L-shaped stem (60) including an annular groove (34) rotatably disposed over said flange (36).

27. An assembly as set forth in claim 26 further characterized by said annular groove (34) including an inner surface (84), said second plate (82) being supported from said inner surface, said radially extending flange (36) having an upper surface supporting said first plate (80) against said second plate (82) to establish an electrical connection through a full 360° rotation of said connector means (26) relative to said support means (60).

* * * * *